US005438233A

United States Patent [19]

Boland et al.

[11] Patent Number: 5,438,233

[45] Date of Patent: Aug. 1, 1995

[54] FILAMENT LAMP INFRARED SOURCE

[75] Inventors: Steven H. Boland, Glendora; James F. Weaver, Monrovia, both of Calif.

[73] Assignee: BHK, Inc., Pomona, Calif.

[21] Appl. No.: 74,995

[22] Filed: Jun. 10, 1993

Related U.S. Application Data

[63] Continuation of Ser. No. 799,036, Nov. 27, 1991, abandoned.

[51] Int. Cl.[6] ..... H01K 1/26

[52] U.S. Cl. ..... 313/110; 313/112; 313/113

[58] Field of Search ..... 313/110, 112, 113, 537, 313/538, 634, 635

[56] References Cited

U.S. PATENT DOCUMENTS

| | | | |
|---|---|---|---|
| 3,189,744 | 6/1965 | Ogland | 313/113 X |
| 3,761,757 | 9/1973 | Muhlbauer et al. | 313/110 |
| 4,104,771 | 8/1978 | Clark et al. | 313/537 |
| 4,274,028 | 6/1981 | Frame | 313/530 |
| 4,604,680 | 8/1986 | Levin et al. | 313/112 X |

*Primary Examiner*—Sandra L. O'Shea
*Assistant Examiner*—Vip Patel
*Attorney, Agent, or Firm*—Boniard I. Brown

[57] ABSTRACT

A lamp configuration particularly for infrared radiation provides an internal arrangement and environment adapted to overcome failure modes of prior art broad band infrared sources, and may incorporate optical elements including spectral filters and lenses enabling wavelength selection, beam shaping, external focusing, collimating, and wave front shaping. It also facilitates optical coupling to external devices including a rotating mirror, shutter and modulator devices.

37 Claims, 2 Drawing Sheets

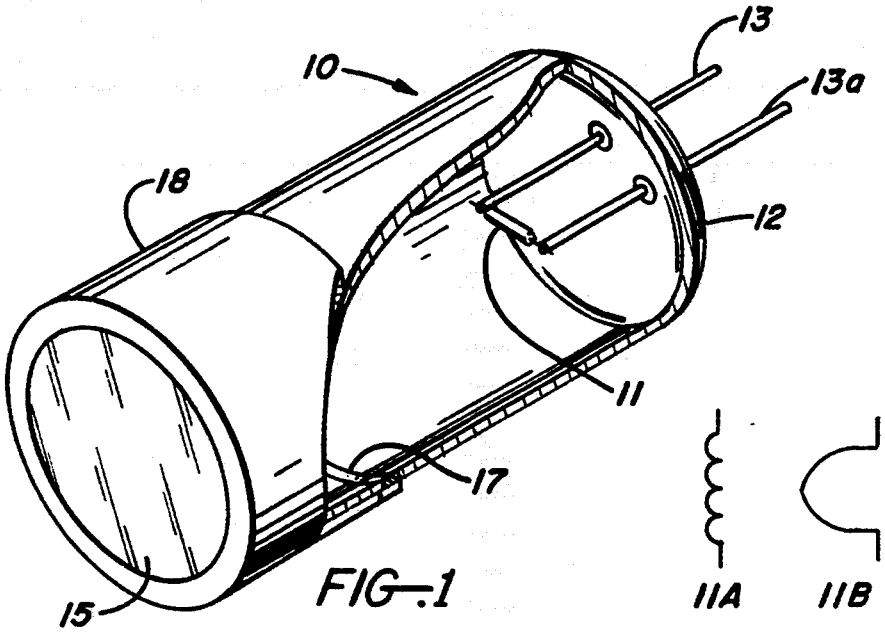
FIG-.1
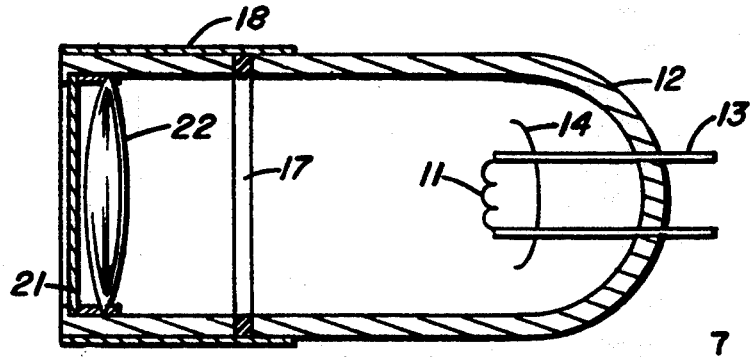
FIG-.2
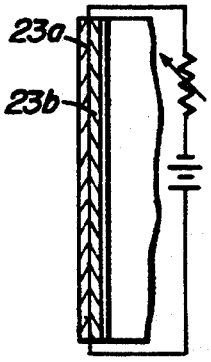
FIG-.3
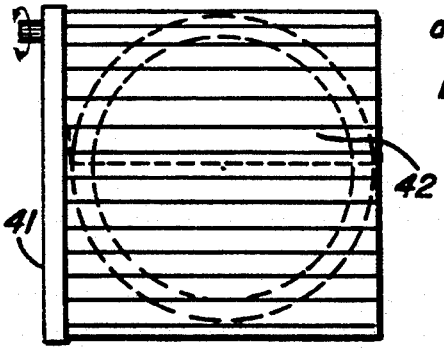
FIG-.4
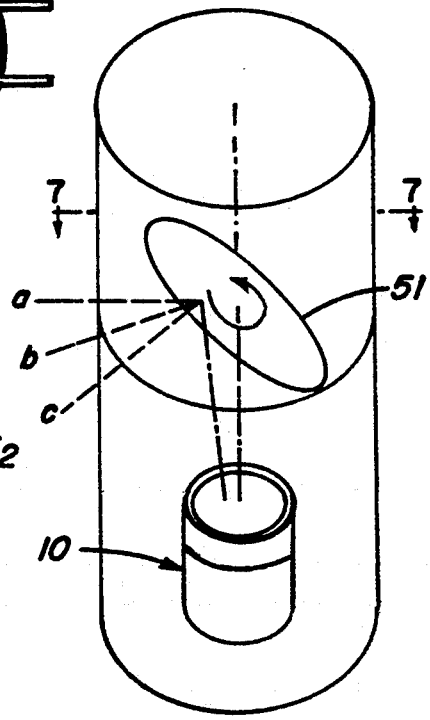
FIG-.5

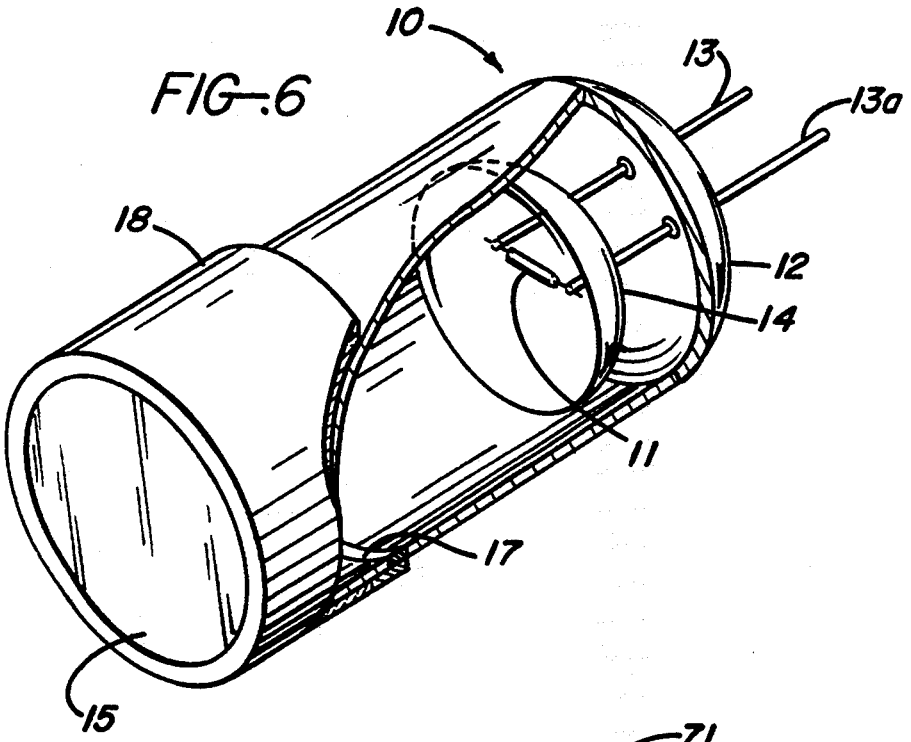
FIG-.6
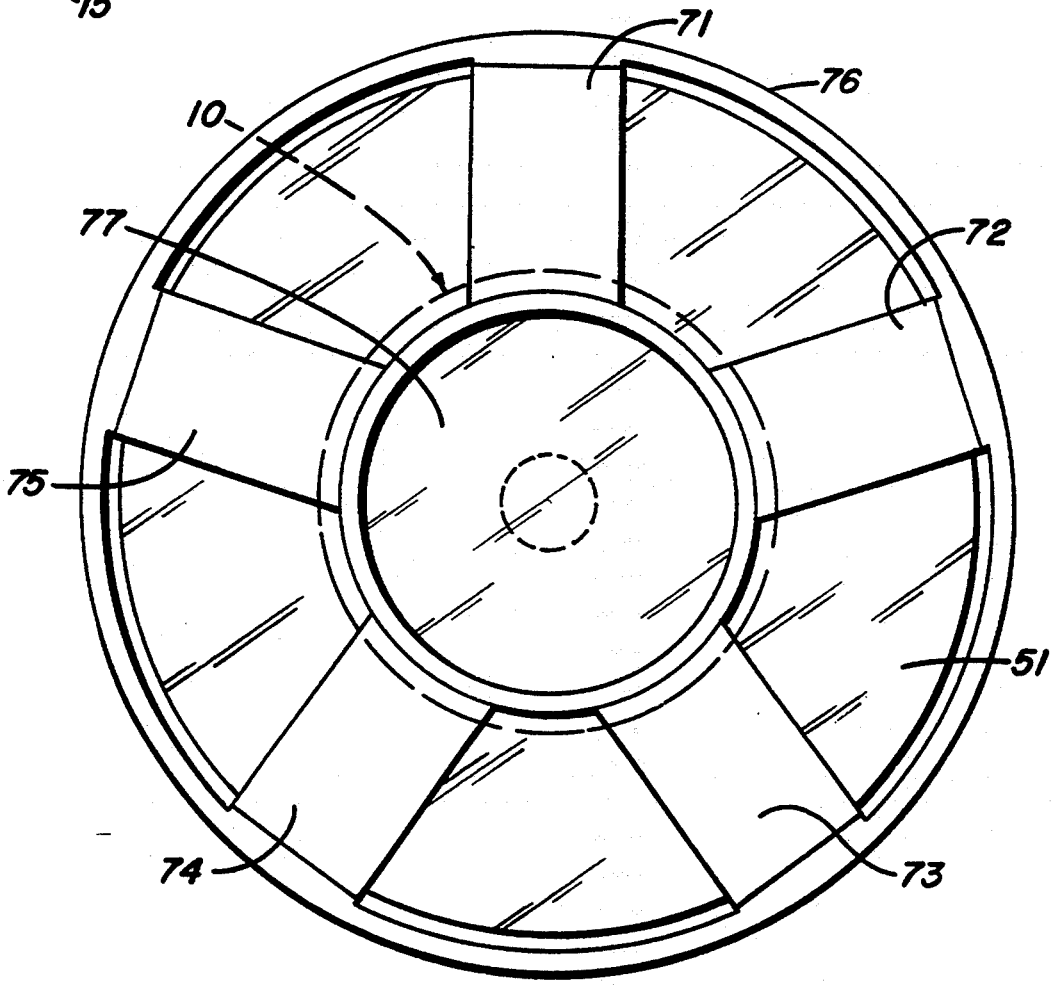
FIG-.7

FILAMENT LAMP INFRARED SOURCE

This is a continuation of application Ser. No. 07/799,036 filed on Nov. 27, 1991, now abandoned.

BACKGROUND OF THE INVENTION

The present invention relates generally to infrared radiation (IR) sources for general application in instrumentation systems including clinical laboratory, industrial, and field instrumentation systems; more particularly, the invention relates to a novel lamp which overcomes the problems associated with prior art IR sources. In addition to analytical, imaging and diagnostic instrumentation, such IR sources have been used in identification of targets in military operations and more particularly for optical "Identification—Friend or Foe" (IFF) systems in which a potential target is interrogated by a signal from an attack aircraft and, if no coded signal is returned, the target is deemed to be legitimate and can be attached. Such systems using interrogation and response signals in the UHF bands have long been used and have used various secrecy coding methods, including pulse code modulation. Later IFF systems utilize infrared wavelengths.

Prior infrared devices for analysis instrumentation involve several limitations, such as short life, low color temperature, fragile construction, high power consumption, starting difficulties, and restricted wavelength emission.

There have been basically four types of infrared sources in use: Nernst glower, globar, gas mantle, and tungsten filament lamps.

The Nernst glower is a device made of a refractory material such as thoria. It is heated by a flame to start, then a controlled current is passed through to maintain and control the desired temperature. The glower typically operates at 200 watts, 60 amperes, and at 1500 to 1950 degrees K temperature. It is continuously energized to insure that it will not break when cooled. The life of the glower depends on operating temperature and careful handling. Lifetimes of 200 to 1000 hours are claimed by various manufacturers.

The gas mantle utilizes a gasoline fired mantle similar to a camping lamp. The mantle is made of thoria and when heated produces a strong emission. The main problems are the hazards of the gaseous fuel, and that its output spectrum does not approximate an ideal blackbody curve.

Tungsten lamps have been used extensively in the visible and near-infrared for many years because of the broad choice of packaging and power levels. Tungsten is an ideal choice of filament material, especially when used in the "Halogen Cycle" to produce higher color temperatures. The disadvantage is that quartz is the only choice for envelope material, limiting the spectral emissions to the region of 3 microns maximum.

The globar is a rod of silicon carbide, which is electrically heated to the desired temperature. It does not require auxiliary heat to start, but requires a flow of water to cool the housing. Typical power is 200 watts, 6 amperes, with color temperatures of 1470 degrees K. Silicon carbide infrared radiation sources are commonly used in the prior art as broad band infrared radiation sources in many infrared spectroscopic instruments. One of the difficulties involved in their extensive use is that they have a failure mode wherein they often crack and become open circuited if powered to high color temperatures over 1500 degrees Kelvin. Environmental factors such as gaseous contamination, thermal stress, and oxidation at the high operating temperature of these devices, as well as vibration and mounting problems, contribute to the possibility of failure of these infrared sources.

It is therefore desirable to provide a closed environment and a reliable mounting for the radiation source material. These systems must consider chemical composition and physical properties such as expansion and contraction over the temperature range.

A closed environment is obtainable by mounting the infrared radiation source in a closed envelope filled with an inert gas free of oxygen and contaminants which would react with the material of the radiation source. Expansion and contraction of the source can be accommodated by filament mounting techniques, e.g., coiled or looped. The source can be further improved by integration with elements to achieve specific optical characteristics, such as output wavelength, collimation, focal length, directionality, and integration with external elements of an optical system.

This lamp makes possible process control instruments for remote locations and portable applications due to its small size, low power consumption, long service life, easy starting, and high color temperature and spectral emission.

SUMMARY OF THE INVENTION

In accordance with the present invention, the combination of a tungsten filament in a lamp with window materials such as zinc selenide, zinc sulphide, sapphire and others, provides the advantages of a tungsten filament lamp for infrared wavelengths up to 20 microns, as compared with the prior art 3 microns. The new lamp is usable as an infrared radiation source having none of the failure modes of prior art infrared sources, and comprising a lamp body constructed from glass, ceramic, metal, or quartz, closed except for filament electrical conductors, including a sealed IR transmitting window. The window may be an optical element such as a lens or a transmissive filter. An indium or indium alloy junction is used to seal the optical element or filter assembly to the body. The lamp is filled with a gas mixture to control heat transfer and minimize deterioration of the filament. A pliable coating overlies the seal junction and part of the body, thus enhancing the resistance of the seal to mechanical shock.

In one embodiment of the invention, a lamp having a tungsten filament at the focus of a parabolic reflector produces a collimated beam to project infrared radiation through a spectral filter for producing a beam of energy having a coherent, narrow band of wavelengths. The Filter may be of one of the following: ZnSe; zinc sulfide, ZnS; sapphire; quartz; silicon, or germanium. An inert gas mixture in the body extends the life of the lamp.

In another embodiment of the invention, a lens is included with or replaces the filter or window at the output end of the lamp. The lens focuses the radiation from the filament onto an external optical element such as a rotating mirror to direct the radiation along arty azimuth, as in an IFF interrogation response beam of a specific wavelength for identification systems.

In another embodiment of the invention, the lamp has an electrically operated polarization filter mounted or deposited at the output for alternate transmission or reflection of the radiation emanating from the filament.

A shutter or rotating mechanical chopper may also be utilized in place of the polarization filter.

BRIEF DESCRIPTION OF THE DRAWINGS

FIG. 1 is an isometric view, partially cut away, showing details of a preferred embodiment of the present invention;

FIG. 2 is a sectional view taken axially of the lamp of FIG. 2;

FIG. 3 is a partial view of the output end of a lamp according to the invention, showing electrically operated window films for modulating light output;

FIG. 4 is a partial view of the output end of a lamp of the invention, showing an external shutter for modulating the out put of the 1amp;

FIG. 5 is an isometric view of a lamp according to the invention, wherein a powered rotating mirror is utilized for directing the output beam of the lamp over any azimuth;

FIG. 6 is an isometric drawing of a lamp having parabolic reflector for directing a beam of the lamp; and FIG. 7 is a top view of the lamp system of FIG. 5, illustrating the use of the lamp of FIG. 6 in a beacon for projecting an output beam over a wide range of directions.

DESCRIPTION OF THE PREFERRED EMBODIMENTS

Referring to FIG. 1, there is shown a lamp 10 constructed with a glass, ceramic, metal, or quartz body 12 closed at one end except for filament pins 13, 13A, and sealed to a window 15 at the opposite end. Other optical components, including integrated optical elements such as filters and compound lenses, may be provided at the window end which defines the aperture for radiation. An indium alloy junction 17 seals the window 15 to the body 12. The lamp is filled with a gas mixture to control heat transfer from the filament. An elastomer coating 18 overlies the seal junction 17, and at least part of the body to enhance seal resistance to mechanical shock.

A filament broad band IR source 11, which may be a tungsten helix 11*a* or a loop 11*b* to accommodate temperature expansion while producing broad band infrared emissions, is mounted on the filament pins 13, 13A. An inert gas mixture environment for the filament 11 controls the heat transfer from the filament.

The window 15 at the radiation aperture may be combined with or replaced by an optical element such as a lens for focusing the filament emission outside the body 12. A discriminator, such as a transmissive filter for defining a narrow wavelength band for the emission output of the lamp, may be provided at the radiation aperture. The window 15 may be one of the materials listed in the table below. These materials have characteristic emission peaks, wavelengths, or infrared cutoff wavelengths.

| Filter | Wavelength (microns) |
|---|---|
| Zn Se | 16+ |
| Zn S | 12+ |
| Sapphire | 5 |
| Quartz | 3 |
| Germanium | 8 |

Referring to the cross-sectional drawing of FIG. 2, the optical characteristics of the lamp can be further defined by the addition of a reflector 14. A parabolic reflector having the filament 11 at its focus provides substantially parallel rays emitted through the transmissive window 15. In accordance with the invention, the novel lamp can be implemented with a reflector producing a collimated beam for projecting infrared energy radiation through a spectral filter, thus to produce a beam of energy having a coherent, narrow band of wavelengths for communications purposes. The reflector 14 may be elliptical (for directing the radiation from an elongated helical filament), hemispherical, parabolic, or other shape to optimize the radiation wave front. A normal wave front with a parabolic reflector would be Gaussian and would be optimum for infrared communications. A window 21 or a meniscus of a compound lens and a convex lens 22, focused at the filament 11, may alternatively be utilized for shaping the output beam of the lamp.

With reference to FIG. 3, the output of the lamp can be modulated by electrically controlling the relative polarization or transmission of films at the output of the lamp. Film 23A having one polorization passes radiation at one polarization angle while the voltage variable polarization of film 23B departs from the polarization of film 23A, thereby causing a darkening of the radiation from the lamp 10 proportional to the difference in polarization angle due to variation of the voltage E across film 23B.

With reference to FIG. 4, means for modulating the radiation output of the lamp consists of a shutter device 41, consisting of slats mechanically actuated to the open or closed position, placed in front of the lamp for signaling or for modulating the output of the lamp 10. The shutter slat 42 is shown in its closed position by dashed line.

Referring to FIG. 5, there is shown a lamp 10 in a directional beacon configuration having an external rotating mirror 51 and a drive mechanism. The combination emits infrared radiation at azimuth directions a, b, c, or any angle over a 360 degree range as the mirror 51 rotates.

Referring to FIG. 6, there is shown a lamp configuration for use in the beacon system of FIG. 5, which lamp is designed for directing a beam of radiation from the filament by means of a parabolic reflector 11 through a transmissive filter and lens combination 15, whereby an intense beam of selected infrared radiation is directed and focused on a rotating mirror which turns to respond to an interrogation signal or turns continously as an identifying beacon.

Referring to FIG. 7, this view of the top of the system of FIG. 5 shows motor support members 71 through 75, the beacon window 76 and a servomotor 77 which rotates the slanted mirror 51, which is inclined at about 30–60 degrees from horizontal. As the mirror 51 turns, it directs the beam of the lamp 10 to any azimuth angle directed by the servomotor 77. The servomotor 77 can respond to a directional signal receiver in an IFF configuration, well known in the art, to return the proper response signal from the local transmitter, or can rotate at a selected rate for omnidirectional identification purposes.

The effectiveness of the lamp as an infrared emission source, particularly in the 8 to 10 micron band, may be enhanced by reducing the background emission. This can be done by mounting it in an environment which has low temperature and low emissivity, as by mounting the lamp so that the emitting aperture of the lamp is surrounded by a polished aluminum reflector. For example, a collapsible reflective paraboloid (Mylar (C) umbrella) for field use, or by a flat area covered with aluminum foil. This greatly increases the contrast and detectability of the lamp emissions.

Thus there has been shown and described a novel filament lamp infrared source which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventors claim:

1. An infrared lamp of broad spectral band output, comprising:

a hollow body having an open end and a closed end, a filament means including filament pins, extending through the body, said filament emitting broad band infrared radiation when an electrical current is passed therethrough, an optical element window disposed on said hollow body and defining an aperture for transmission of radiation from said filament, an indium alloy junction comprising indium between said window and said body to seal said window to said body, a pliable coating overlaying said indium alloy junction and at least part of said body, and a gas contained in said hollow body in contact with said filament to control temperature and to prevent deterioration of said filament.

2. An infrared lamp according to claim 1, and further comprising:

reflector means having the focus thereof at the filament and having an open end facing said window, whereby a shaped beam is radiated therethrough.

3. An infrared lamp according to claim 2, wherein said reflector means is a parabola to produce a substantially collimated beam.

4. An infrared lamp according to claim 2, wherein said reflector means is hemispherical.

5. An infrared lamp according to claim 2, wherein said reflector means is an ellipse having the focus thereof at said filament and the major axis thereof extending parallel to the filament.

6. An infrared lamp according to claim 2, wherein said reflector means is configured to shape the radiation wave front emitted from the lamp.

7. An infrared lamp according to claim 1, and further comprising:

a selective band transmissive spectral filter, whereby a coherent selected band spectral output is radiated by the lamp.

8. An infrared lamp according to claim 2, and further comprising:

a selective band transmissive spectral filter, whereby a coherent selected band spectral output is radiated by the lamp.

9. An infrared lamp according to claim 3, and further comprising:

a selective band transmissive spectral filter, whereby a coherent selected band spectral output is radiated by the lamp.

10. An infrared lamp according to claim 9, wherein said transmissive spectral filter is ZnSe.

11. An infrared lamp according to claim 9, wherein said transmissive spectral filter is ZnS.

12. An infrared lamp according to claim 9, wherein said transmissive spectral filter is sapphire.

13. An infrared lamp according to claim 9, wherein said transmissive spectral filter is germanium.

14. An infrared lamp according to claim 1, wherein:

said window has a broad band output and an infrared cut-off wavelength, whereby radiation at wavelengths longer than the cut-off wavelength is attenuated.

15. An infrared lamp according to claim 14, wherein:

said window has a broad band output and an infrared cut-off wavelength, and the window is quartz.

16. An infrared lamp according to claim 7, wherein said optical element window is a convex lens, whereby the radiation is focused outside the body of the lamp.

17. An infrared lamp according to claim 8, wherein said optical element window is a convex lens, whereby the radiation is focused outside the body of the lamp.

18. An infrared lamp according to claim 7, wherein said optical element window is a compound lens.

19. An infrared lamp according to claim 8, wherein said optical element window is a compound lens.

20. An infrared lamp according to claim 7, wherein said optical element window is a reticle.

21. An infrared lamp according to claim 8, wherein said optical element window is a reticle.

22. An infrared lamp according to claim 7, wherein said optical element window is a broad band filter.

23. An infrared lamp according to claim 8, wherein said optical element window is a broad band filter.

24. An infrared lamp according to claim 1, and further including:

polarization means at the lamp output, and electrical means for controlling the transmission of the polarization means to modulate lamp output.

25. An infrared lamp according to claim 24, wherein the polarization means comprise films at said window.

26. An infrared lamp having a narrow spectral band output and a substantially collimated beam, comprising:

a quartz tube body, said body having filament pins extending through the body, a transmissive spectral filter sealed to the body defining a window for radiation, an indium alloy junction sealing said filter to the body, a pliable overcoating overlying the seal junction and at least part of the quartz body, filament means in the lamp and extending through the closed end of the quartz tube body, the filament means being at the focus of a deep parabolic reflector with substantially parallel sides near its open end, an inert gas in the lamp to control heat transfer from the filament, and means for energizing said filament, whereby a narrow band collimated beam of infrared radiation of specified wavelength band is obtained for communications.

27. An infrared lamp according to claim 24 and further including:

rotating mirror means directing the radiation output from said lamp along azimuths over 360 degrees oriented orthogonally to the lamp.

28. An infrared lamp according to claim 24 and further including:

shutter means interrupting the radiation emitted from said lamp to pass coded information.

29. An infrared lamp according to claim 26, and further including:

polarization means at the lamp output, and electrical means for controlling the transmission of the polarization means to modulate lamp output.

30. An infrared lamp according to claim 29, wherein the polarization means comprise films at said window.

31. An infrared lamp according to claim 1, wherein said hollow body is formed of glass.

32. An infrared lamp according to claim 1, wherein said hollow body is formed of quartz.

33. An infrared lamp according to claim 1, wherein said hollow body is formed of sapphire.

34. An infrared lamp according to claim 1, wherein said hollow body is formed of alumina ceramic AlO .

35. An infrared lamp according to claim 1, wherein said hollow body is formed of ceramic BeO.

36. An infrared lamp according to claim 1, wherein said hollow body is formed of metal.

37. An infrared lamp according to claim 1, and further comprising:

means surrounding said lamp and having a low emissivity in contrast with the emissivity of the lamp, whereby the detectability of the lamp is enhanced.

* * * * *